US009869161B2

(12) United States Patent
VanDam et al.

(10) Patent No.: US 9,869,161 B2
(45) Date of Patent: Jan. 16, 2018

(54) GAS VENT SYSTEM AND METHODS OF OPERATING THE SAME

(71) Applicants: Jeremy Daniel VanDam, West Coxsackie, NY (US); Zhipeng Zhang, Cupertino, CA (US); Ameen Aboel Hassan Muhammed, Green Island, NY (US)

(72) Inventors: Jeremy Daniel VanDam, West Coxsackie, NY (US); Zhipeng Zhang, Cupertino, CA (US); Ameen Aboel Hassan Muhammed, Green Island, NY (US)

(73) Assignee: General Electric Company, Niskayuna, NY (US)

( * ) Notice: Subject to any disclaimer, the term of this patent is extended or adjusted under 35 U.S.C. 154(b) by 290 days.

(21) Appl. No.: 14/570,698

(22) Filed: Dec. 15, 2014

(65) Prior Publication Data

US 2016/0084042 A1 Mar. 24, 2016

Related U.S. Application Data

(60) Provisional application No. 62/053,571, filed on Sep. 22, 2014.

(51) Int. Cl.

| | |
|---|---|
| ***E21B 43/08*** | (2006.01) |
| ***E21B 43/38*** | (2006.01) |
| ***E21B 34/06*** | (2006.01) |
| ***E21B 43/12*** | (2006.01) |
| ***E21B 43/30*** | (2006.01) |

(52) U.S. Cl.

CPC ..... *E21B 34/066* (2013.01); *E21B 43/12* (2013.01); *E21B 43/305* (2013.01); *E21B 43/38* (2013.01)

(58) Field of Classification Search

CPC ..... E21B 43/086; E21B 43/08; E21B 43/34; E21B 43/38

USPC ..... 166/74, 105.5, 265, 229, 234, 50

See application file for complete search history.

(56) References Cited

U.S. PATENT DOCUMENTS

| | | | | |
|---|---|---|---|---|
| 3,797,968 | A | 3/1974 | Elfarr | |
| 3,967,633 | A | 7/1976 | Hallanger et al. | |
| 4,826,519 | A * | 5/1989 | Miyagi | B01D 46/24 55/487 |

(Continued)

FOREIGN PATENT DOCUMENTS

| | | | |
|---|---|---|---|
| WO | 0227141 | A1 | 4/2002 |
| WO | 2010070289 | A2 | 6/2010 |

OTHER PUBLICATIONS

PCT Search Report and Written Opinion issued in connection with corresponding PCT Application No. PCT/US2015/051207 dated Jan. 4, 2016.

(Continued)

*Primary Examiner* — Kenneth L Thompson

(74) *Attorney, Agent, or Firm* — Pabitra K. Chakrabarti

(57) ABSTRACT

A gas intake apparatus for use in a wellbore configured to channel a mixture of fluids and solids includes a housing defining a chamber and at least one gas intake passage in flow communication with the chamber. The gas intake apparatus further includes a gas intake mechanism coupled to the housing at the at least one gas intake passage. The gas intake mechanism is configured to facilitate a flow of gaseous substances therethrough and to restrict a flow of solids and liquids therethrough.

20 Claims, 6 Drawing Sheets

(56) References Cited

U.S. PATENT DOCUMENTS

| | | | | |
|---|---|---|---|---|
| 5,762,093 | A | 6/1998 | Whitley, II | |
| 6,228,146 | B1 | 5/2001 | Kuespert | |
| 6,502,766 | B1 | 1/2003 | Streutker et al. | |
| 6,601,651 | B2 | 8/2003 | Grant | |
| 6,752,330 | B2 | 6/2004 | DiMaggio et al. | |
| 6,969,046 | B2 | 11/2005 | Streutker et al. | |
| 6,973,973 | B2 | 12/2005 | Howard et al. | |
| 6,981,658 | B2 | 1/2006 | Streutker et al. | |
| 7,311,152 | B2 | 12/2007 | Howard et al. | |
| 7,445,049 | B2 | 11/2008 | Howard et al. | |
| 7,673,676 | B2 * | 3/2010 | Rivas | E21B 43/128 166/105.5 |
| 7,757,761 | B2 * | 7/2010 | Augustine | E21B 43/082 166/276 |
| 8,573,408 | B2 * | 11/2013 | Ishizuka | B01D 67/0027 210/500.21 |
| 8,640,930 | B2 | 2/2014 | Nunez et al. | |
| 2005/0241382 | A1 | 11/2005 | Coenen | |
| 2011/0017472 | A1 | 1/2011 | Maxwell | |
| 2013/0092393 | A1 | 4/2013 | Dykstra et al. | |
| 2013/0098629 | A1 | 4/2013 | Wilson | |
| 2016/0177666 | A1 * | 6/2016 | Van Dam | E21B 34/08 166/250.15 |

OTHER PUBLICATIONS

Cooper et al., "An Overview of Horizontal Well Completion Technology", Society of Petroleum Engineers, One Petro , No. of Pages 16, Tianjin, China , Nov. 1-4, 1988.

* cited by examiner

GAS VENT SYSTEM AND METHODS OF OPERATING THE SAME

CROSS-REFERENCE TO RELATED APPLICATIONS

This application claims benefit of U.S. Provisional Patent Application Ser. No. 62/053,571 filed Sep. 22, 2014 entitled "GAS VENT SYSTEM AND METHODS OF OPERATING THE SAME", which is hereby incorporated by reference in its entirety.

BACKGROUND

This disclosure relates generally to oil or gas producing wells, and, more specifically, the disclosure is directed to horizontal wells having a gas vent system for removing gas from a wellbore.

The use of directionally drilled wells to recover hydrocarbons from subterranean formations has increased significantly in the past decade. A large number of wells exist whereby a substantially vertical section is drilled to a depth where hydrocarbon source rock has been identified, and then the direction of the well is turned to follow the path of the source rock along a substantially horizontal distance. The geometry of the wellbore along the substantially horizontal portion typically exhibits elevation changes, such that one or more peaks and valleys occur. It is typical for multiple production zones to be provided along the length of the substantially horizontal section of the wellbore, such that materials can pass from the formation into the wellbore, then be channeled along the wellbore. These materials may consist of one or more of gaseous, liquid, or solid phase substances.

In at least some known horizontal wells, the transport of both liquid and gas phase materials along the wellbore results in unsteady flow regimes including slugging, or gas slugging. Under the influence of gravity, the liquid and solid phase materials having higher density tend to settle in the lower elevation valleys of the wellbore, while the lower density gas phase materials tend to collect in the higher elevation peaks of the wellbore. Fluids that have filled the wellbore in lower elevations impede the transport of gas along the length of the wellbore. This phenomena results in a buildup of pressure along the length of the substantially horizontal wellbore section, reducing the maximum rate at which fluids can enter the wellbore from the formation. Continued inflow of fluids and gasses cause gas the trapped gas pockets to build in pressure and in volume until a critical pressure and volume is reached, whereby a portion of the trapped gas escapes passed the fluid blockage and migrates as a slug along the wellbore.

Furthermore, at least some known horizontal wells include pumps that are designed to process pure liquid or a consistent mixture of liquid and gas. However, under slugging conditions, when the pump encounters a slug of gas, the pump is operating in dry conditions for a period of time until the gas slug passes and liquid again reaches the pump. Operating the pump without liquids may cause a reduction in the expected operational lifetime of the pump. Additionally, the pump may undergo a large load fluctuation during slugging conditions. More specifically, the pump requires a relatively large amount of power to lift large volumes of liquid during standard operation. When a gas slug reaches the pump, the pump may experience a drop in power consumption because it is no longer doing work. Subsequently, when liquid encounters the pump again, the power consumption increases significantly over a relatively short period of time. Such load fluctuations reduce pumping efficiency and may further reduce the expected operational lifetime of the pump, the driver that operates the pump, and the power delivery system that supplies power to the pump.

BRIEF DESCRIPTION

In one aspect, a gas intake apparatus for use in a wellbore is provided. The wellbore is configured to channel a mixture of fluids and solids. The gas intake apparatus includes a housing defining a chamber and at least one gas intake passage in flow communication with the chamber. The gas intake apparatus further includes a gas intake mechanism coupled to the housing at the at least one gas intake passage. The gas intake mechanism is configured to facilitate a flow of gaseous substances therethrough and to restrict a flow of solids and liquids therethrough.

In another aspect, a gas vent system for use in a wellbore is provided. The wellbore is configured to channel a mixture of fluids and solids. The gas vent system includes a gas vent conduit positioned within the wellbore and at least one gas intake apparatus coupled to the gas vent conduit. Each gas intake apparatus includes a gas intake mechanism configured to facilitate a flow of gaseous substances therethrough and to restrict a flow of solids and liquids therethrough.

In another aspect, a method of operating a well using a gas vent system is provided. The method includes positioning a gas vent conduit within a wellbore of the well. The gas vent conduit includes at least one gas intake apparatus coupled thereto that includes a gas intake mechanism. The method also includes channeling substances about the at least one gas intake apparatus. The substances include one or more of at least one gaseous substance, at least one solid substance, and at least one liquid substance. At least a portion of the at least one gaseous substance is channeled through the gas intake mechanism, and a flow of the at least one solid substance and the at least one liquid substance is restricted from flowing through the gas intake mechanism.

DRAWINGS

These and other features, aspects, and advantages of the present disclosure will become better understood when the following detailed description is read with reference to the accompanying drawings in which like characters represent like parts throughout the drawings, wherein.

Figure 1:
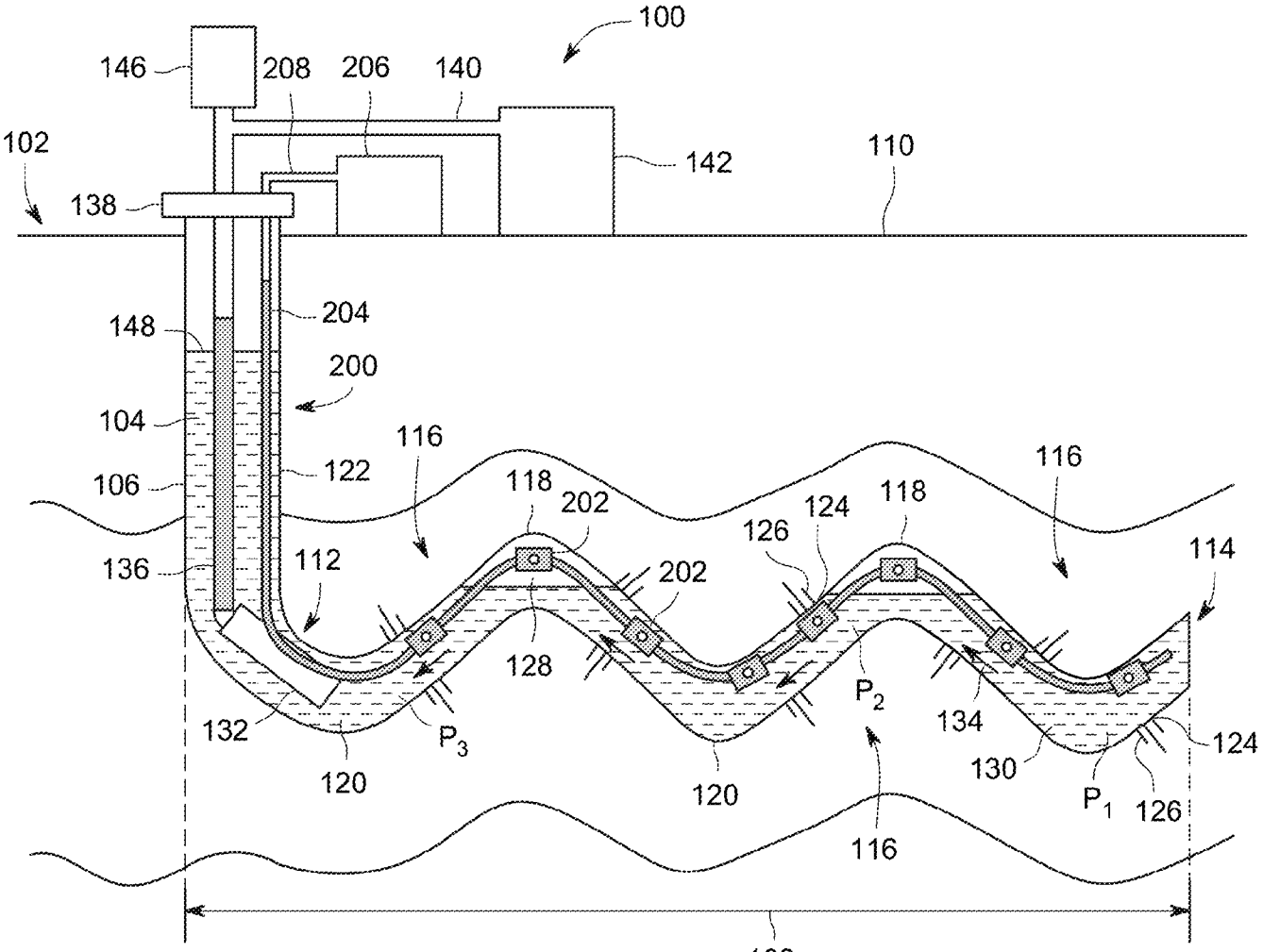
FIG. 1 is a schematic illustration of a horizontal well including an exemplary gas vent system.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

Approximating language, as used herein throughout the specification and claims, is applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations are combined and interchanged, such ranges are identified and include all the sub-ranges contained therein unless context or language indicates otherwise.

The horizontal well systems described herein facilitate efficient methods of well operation. Specifically, in contrast to many known well operations, the horizontal well systems as described herein substantially remove gaseous substances from a wellbore to substantially reduce the formation of gas slugs. More specifically, the horizontal well systems described herein include a gas vent system that includes at least one gas intake apparatus positioned in a horizontal portion of a wellbore and distributed along a common gas conduit. Each of the gas intake apparatuses include a gas intake mechanism that facilitates a flow of gaseous substances therethrough when the apparatus is surrounded by gas and that restricts a flow of a mixture of solids and liquids therethrough when the apparatus is at least partially submerged in the mixture. In one embodiment, the apparatus includes a gas-permeable membrane that filters gaseous substances from liquids and solids. In another embodiment, each apparatus includes an actuator assembly that includes a sensor, an actuator, and a sealing device. In such embodiments, the sensor determines whether the apparatus is surrounded by gas or by liquids. Once a determination is made, the sensor signals to the actuator to control the sealing device accordingly such that the sealing device is either open to allow gas into the apparatus or closed to significantly gas and liquids from entering the apparatus.

As such, the gas vent systems described herein provide gaseous substances with an escape path that bypasses the pump and removes substantially all of the gaseous substances from within the horizontal portion of the wellbore prior to the gases reaching the pump such that only the liquid mixture encounters the pump. Alternatively, the gas vent systems described herein are used in horizontal wells that seek to recover only gaseous substances, and, therefore, do not include a pump. Accordingly, the gas vent systems described herein substantially eliminate both the buildup of pressure upstream from the pump and the formation of slugs, as described above. More specifically, the gas vent system described herein substantially reduces the buildup of pressure within the wellbore such that the horizontal portion of the wellbore achieves a nearly constant minimum pressure along its length and enables a maximized production rate and total hydrocarbon recovery of the horizontal well.

FIG. 1 is a schematic illustration of an exemplary horizontal well system 100 for removing materials from a well 102. In the exemplary embodiment, well 102 includes a wellbore 104 having a substantially vertical portion 106 and a substantially horizontal portion 108. Vertical portion 106 extends from a surface level 110 to a heel 112 of wellbore 104. Horizontal portion 108 extends from heel 112 to a toe 114 of wellbore 104. In the exemplary embodiment, horizontal portion 108 follows a stratum 116 of hydrocarbon-containing material formed beneath surface 110, and, therefore, includes a plurality of peaks 118 and a plurality of valleys 120 defined between heel 112 and toe 114. As used herein, the term "hydrocarbon" collectively describes oil or liquid hydrocarbons of any nature, gaseous hydrocarbons, and any combination of oil and gas hydrocarbons.

Wellbore 104 includes a casing 122 that lines portions 106 and 108 of wellbore 104. Casing 122 includes a plurality of perforations 124 in horizontal portion 108 that define a plurality of production zones 126. Hydrocarbons from stratum 116, along with other liquids, gases, and granular solids, enter horizontal portion 108 of wellbore 104 via production zones 126 through perforations 124 in casing 122 and substantially fills horizontal section 108 with gas substances 128 and a mixture 130 of liquids and granular solids. In the exemplary embodiment, "liquid" includes water, oil, fracturing fluids, or any combination thereof, and "granular solids" include relatively small particles of sand, rock, and/or engineered proppant materials that are able to be channeled through perforations 124.

Horizontal well system 100 also includes a pump 132 positioned proximate heel 112 of wellbore 104. Pump 132 is configured to draw liquid mixture 130 through horizontal portion 108 such that liquid mixture 130 flows in a direction 134 from toe 114 to heel 112. Pump 132 is fluidly coupled to a production tube 136 that extends from a wellhead 138 of well 102. Production tube 136 is fluidly coupled to a liquid removal line 140 that leads to a liquid storage reservoir 142. In one embodiment, liquid removal line 140 may include a filter (not shown) to remove the granular solids from liquid mixture 130 within line 140. Pump 132 is operated by a driver mechanism 146 that permits pumping of liquid mixture 130 from wellbore 104. In operation, liquid mixture 130 travels from pump 132, through production tube 136 and liquid removal line 140, and into storage reservoir 142.

In the exemplary embodiment, horizontal well system 100 further includes a gas vent system 200 that is configured to channel primarily gaseous substances 128 from within horizontal portion 108 of wellbore 104 such that gaseous substances 128 are provided with an escape path from wellbore 104 that is independent of an escape path, i.e., production tube 136, for liquid mixture 130. Gas vent system 200 includes at least one gas vent apparatus 202 distributed along a gas conduit 204. In the exemplary embodiment, gas conduit 204 is configured to channel primarily gaseous substances 128 from within horizontal portion 108 of wellbore 104 through wellhead 138 to a gas storage reservoir 206 via a gas removal line 208. Alternatively, gas conduit 204 channels gaseous substances 128 to a location above a liquid level 148 and vents gases 128 in wellbore 104. Generally, gas conduit 204 channels gas 128 to any location that facilitates operation of gas vent system 200 as described herein.

As shown in FIG. 1, during operation of horizontal well system 100, substances 128 and 130 enter horizontal portion 108 of wellbore 104 through production zones 126 such that the more dense mixture of liquids and granular solids collect in valleys 120 of portion 108 and less dense gaseous substances 128 collect in peaks 118. Accordingly, a portion of apparatuses 202 are submerged in liquid mixture 130, while a portion of apparatuses 202 are exposed to only gaseous substances 128. When pump 132 is operational, substances 128 and 130 are drawn in flow direction 134 toward heel 112 such that each gas intake apparatus 202 is exposed to both gaseous substances 128 and liquid mixture 130 at different times. When an apparatus 202 is surrounded by only gaseous substances 128, that apparatus 202 facilitates entry of gaseous substances 128 into gas conduit 204 where gases 128 mix with gases 128 that have previously entered gas vent system 200 through an upstream apparatus 202, when apparatus 202 is not the most upstream apparatus, and are channeled via gas conduit 204 through the remaining apparatuses 202 until gaseous substances 128 are channeled to reservoir 206.

In contrast, when a gas intake apparatus 202 is at least partially submerged in liquid mixture 130, that apparatus 202 is configured to restrict ingress of liquid mixture 130 into gas conduit 204 through apparatus 202. Accordingly, gas intake apparatuses 202 and gas conduit 204 of gas vent system 200 provide gaseous substances 128 with an escape path that bypasses pump 132 and removes a majority of gaseous substances 128 from within horizontal portion 108 of wellbore 104 prior to gases 128 reaching pump 132 such that only liquid mixture 130 encounters pump 132. Therefore, gas vent system 200 substantially eliminates the formation of slugs, described above, and reduces gas intake of pump 132. More specifically, gas vent system 200 substantially reduces the buildup of pressure within horizontal portion 108 of wellbore 104 such that a pressure at a first point P1, proximate toe 114, is substantially similar to a pressure at a second point P2, along portion 108, and to a pressure at a third point P3, proximate heel 112. More specifically, gas vent system 200 removes the increase in pressure along horizontal portion 108 due to liquid blockage of pressurized gas pockets. However, some pressure differences along portion 108 will remain due to elevation changes and the weight of liquid mixture 130, where lower elevations have higher pressures. As a result, each production zone 126 along horizontal portion 108 has a substantially uniform production rate with respect to wellbore pressure rather than production zones 126 proximate heel 112 and point P3 having significantly higher production rates than production zones 126 proximate toe 114 and point P1.

Figure 2:
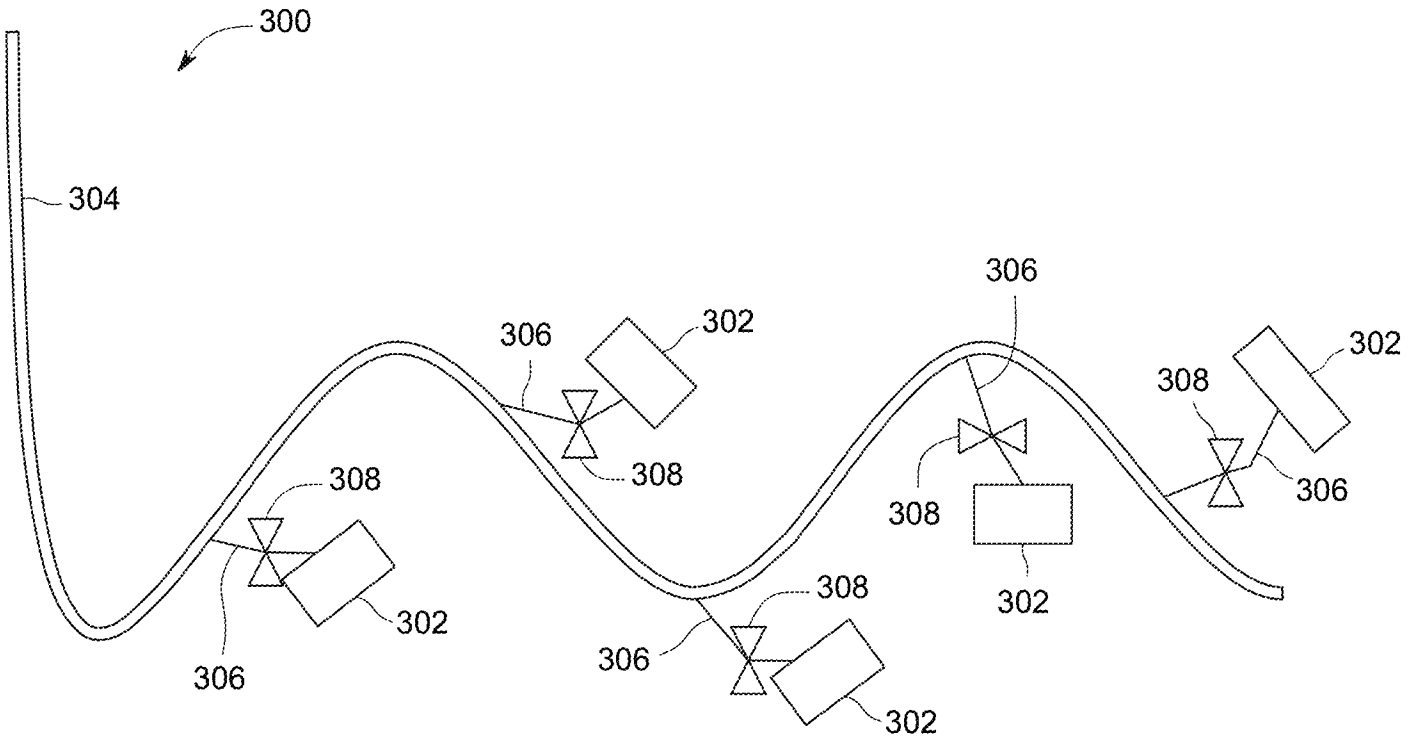
FIG. 2 is a schematic illustration of a horizontal well including an alternative gas vent system.

In the exemplary embodiment, shown in FIG. 1, gas vent apparatuses 202 are coupled in series such that gaseous substances 128 from upstream portions of horizontal portion 108, proximate toe 114, flow through each apparatus 202 en route to reservoir 206. FIG. 2 is a schematic illustration of a horizontal well, such as horizontal well 102 (shown in FIG. 1) including an alternative gas vent system 300. Gas vent system 300 includes at least one gas vent apparatus 302 coupled in parallel to a main gas conduit 304. Each apparatus 302 is coupled to conduit 304 via a branch conduit 306. Branch conduit 306 includes a controllable valve 308 that may be selectively controlled to either allow or restrict substances from the respective apparatus 302 from flowing through the respective branch conduit 306 and into main gas conduit 304.

Figure 3:
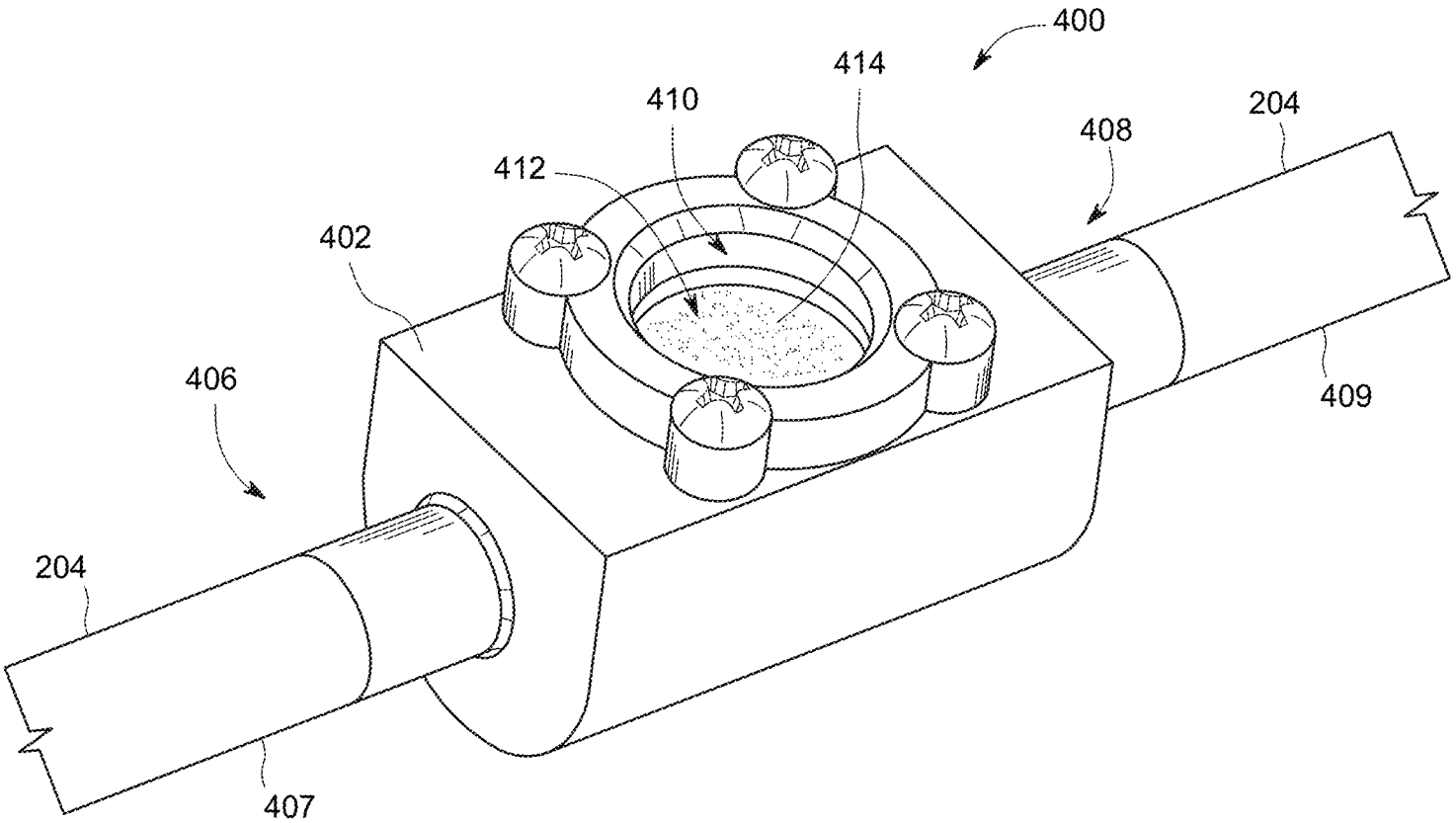
FIG. 3 is a perspective view of an exemplary gas intake apparatus that may be used with the gas vent system shown in FIG. 1.
Figure 4:
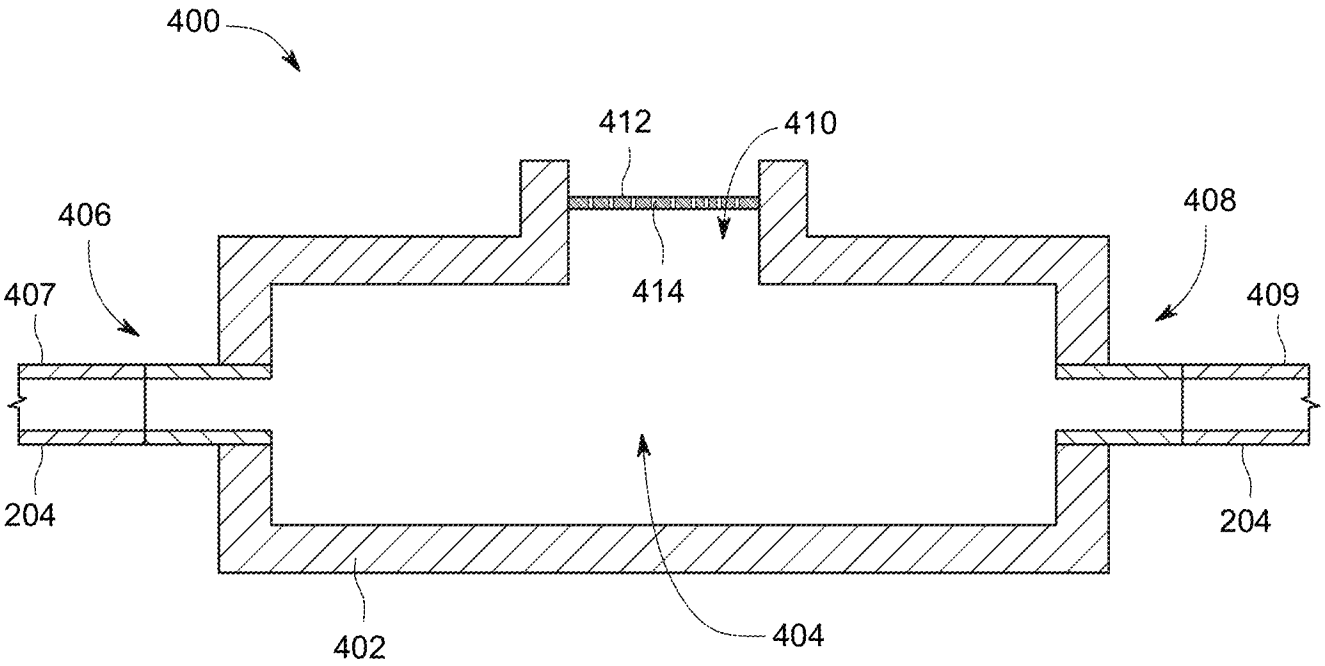
FIG. 4 is a cross-sectional view of the gas intake apparatus shown in FIG. 3.

FIG. 3 is a perspective view of an exemplary gas intake apparatus 400 of the at least one apparatus 202 (shown in FIG. 1) that may be used with gas vent system 200 (shown in FIG. 1). FIG. 4 is a cross-sectional view of gas intake apparatus 400. Referring to FIGS. 3 and 4, each gas intake apparatus 400 of the plurality of apparatuses 202 includes a housing 402 that defines an interior chamber 404. Housing 402 includes a first end 406 coupled to a downstream portion 407 of gas conduit 204 and a second end 408 coupled to an upstream portion 409 of gas conduit 204. Housing 402 also includes at least one gas intake passage 410 that is in flow communication with chamber 404. Gas intake apparatus 400 also includes a gas intake mechanism 412 coupled to housing 402 at gas intake passage 410 such that gas intake mechanism 412 is configured to facilitate a flow of gaseous substances 128 (shown in FIG. 1) therethrough and to restrict a flow of mixture of liquids and solids 130 (shown in FIG. 1) therethrough.

In the exemplary embodiment, gas intake mechanism 412 is at least one layer of a membrane having a plurality of micro-pores 414. Micro-pores 414 of membrane 412 are configured to act as a filter that allows gaseous substances 128 to flow therethrough, while restricting liquid mixture 130 from flowing therethrough. In the exemplary embodiment, membrane 412 is made from a material that includes at least one of polytetrafluoroethylene, polyetheretherkeytone, and polyetherkeytone. Alternatively, membrane 412 is made from of a material such as, but not limited to, polymer-based or ceramic-based materials. Generally, membrane 412 is made from any material that enables operation of gas intake apparatus 400 as described herein.

In operation, apparatuses 400 are distributed along gas conduit 204 within horizontal portion 108 of wellbore 106 (both shown in FIG. 1). When gas intake apparatus 400 is surrounded by gaseous substances 128, membrane 412 facilitates entry of gaseous substances 128 through micro-pores 414 and into chamber 404. Furthermore, when gas intake apparatus is surrounded by liquid mixture 130, membrane 412 facilitates entry of gaseous substances 128 entrained within liquid mixture 130. In embodiments where apparatus 400 is not the most upstream apparatus, gases 128 within chamber 404 mix with gases 128 that have previously entered gas vent system 200 (shown in FIG. 1) through an upstream apparatus 400. Gases 128 are channeled via gas conduit 204 through the remaining apparatuses 400 until gaseous substances 128 are channeled to reservoir 206 (shown in FIG. 1).

In contrast, when gas intake apparatus 400 is submerged in liquid mixture 130, membrane 412 obstructs ingress of liquid mixture 130 into chamber 404 through gas intake passage 410. As such, apparatuses 400 and gas conduit 204 of gas vent system 200 provide gaseous substances 128 with an escape path that bypasses pump 132 (shown in FIG. 1) and removes substantially all of gaseous substances 128 from within horizontal portion 108 of wellbore 104 prior to gases 128 reaching pump 132 such that only liquid mixture 130 encounters pump 132. Accordingly, gas vent system 200 substantially eliminates the formation of slugs, described above, and reduces gas intake of pump 132. More specifically, gas vent system 200 substantially reduces the buildup of pressure within horizontal portion 108 of wellbore 104 such that a pressure at first point P1 is substantially similar to a pressure at second point P2 and to a pressure at third point P3. As a result, each production zone 126 along horizontal portion 108 has a substantially similar production rate rather than production zones 126 proximate heel 112 and point P3 having significantly higher production rates than production zones 126 proximate toe 114 and point P1.

Figure 5:
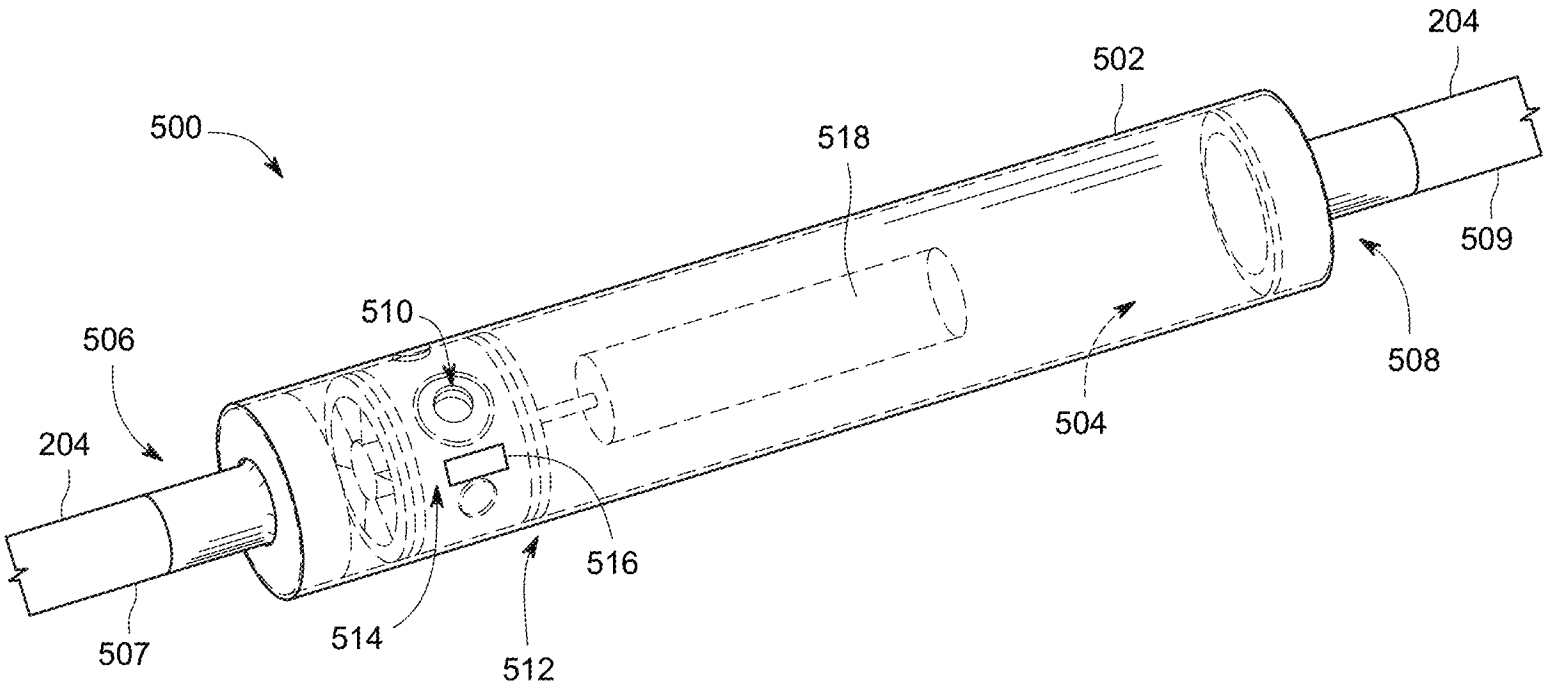
FIG. 5 is a perspective view of an alternative gas intake apparatus that may be used with the gas vent system shown in FIG. 1.

FIG. 5 is a perspective view of an alternative gas intake apparatus 500 that may be used with gas vent system 200

(shown in FIG. 1). Each gas intake apparatus 500 of the at least one apparatus 202 (shown in FIG. 1) includes a housing 502 that defines an interior chamber 504. Housing 502 includes a first end 506 coupled to a downstream portion 507 of gas conduit 204 and a second end 508 coupled to an upstream portion 509 of gas conduit 204. Housing 502 also includes at least one gas intake passage 510 that is in flow communication with chamber 504. Gas intake apparatus 500 also includes a gas intake mechanism 512 coupled to housing 502 at gas intake passage 510 such that gas intake mechanism 512 is configured to facilitate a flow of gaseous substances 128 (shown in FIG. 1) therethrough and to restrict a flow of mixture of liquids and solids 130 (shown in FIG. 1) therethrough.

In this embodiment, gas intake mechanism 512 is an actuation assembly that includes a sealing device 514, a sensor 516, and an actuator 518. Sensor 516 is positioned proximate gas intake passage 510 and is configured to determine the physical state of fluid proximate gas intake passage 510. More specifically, sensor 516 is configured to determine whether the fluid proximate gas intake passage 510 is comprised of gaseous substances 128 or liquid mixture 130. In the exemplary embodiment, sensor 516 is an electronic sensor, such as, but not limited to, a capacitance sensor, an optical sensor, an ultrasonic sensor, an acoustic sensor, a microwave sensor, a mass flow sensor, a conductivity sensor, and a density sensor, that transmits an electrical signal to actuator 518. Alternatively, sensor 516 is any type of sensor able that enables determining of the physical state of a fluid proximate intake passage 510.

Actuator 518 is configured to selectively control sealing device 514 based on the physical state of the fluid proximate intake passage 510 as determined by sensor 516. In the exemplary embodiment, actuator 518 is an electric motor positioned within chamber 504 that selectively controls sealing device 514 based on the signal received from sensor 516. Alternatively, actuator 518 is any type of actuator positioned at any location on apparatus 500 that is configured to receive a signal from sensor 518 and selectively control sealing device 514 based on the signal. Additionally, in the exemplary embodiment of apparatus 500, sealing device 514 is a rotating sleeve coupled about housing 502 and configured to be moveable by actuator 518 between a first position and a second position based on the state of the fluid proximate gas intake passage 510 as determined by sensor 516. In one embodiment, apparatus 500 includes an accelerometer (not shown) that determines the direction of gravity to determine the orientation of apparatus 500 within horizontal portion 108. Information from sensor 516 and the accelerometer facilitates opening a gas intake passage 510 that is exposed to gaseous substances 128 when other passages 510 on the same apparatus 500 are exposed to liquid mixture 130. In the first position, sealing device 514 facilitates channeling gaseous substances 128 through gas intake passage 510, and, in the second position, sealing device 514 rotates to cover gas intake passage 510 such that liquid mixture 130 is restricted from flowing therethrough.

In operation, apparatuses 500 are distributed along gas conduit 204 within horizontal portion 108 of wellbore 106 (both shown in FIG. 1). When gas intake apparatus 500 is surrounded by only gaseous substances 128, gas intake mechanism 512 facilitates entry of gaseous substances 128 through gas intake passage 510 and into chamber 504. More specifically, a sensor, such as electronic sensor 516, determines that only gases 128 are proximate passage 510 and signals to an actuator, such as electric motor 518, to operate a sealing device, such as rotating ring 514, to open passage 510 to intake gases 128 into chamber 504. In embodiments where apparatus 500 is not the most upstream apparatus, gases 128 within chamber 504 mix with gases 128 that have previously entered gas vent system 200 (shown in FIG. 1) through an upstream apparatus 500. Gases 128 are then channeled via gas conduit 204 through the remaining apparatuses 500 until gaseous substances 128 are channeled to reservoir 206 (shown in FIG. 1).

In contrast, when gas intake apparatus 500 is at least partially submerged in liquid mixture 130, gas intake mechanism 512 obstructs ingress of liquid mixture 130 into chamber 504 through gas intake passage 510. More specifically, sensor 516 determines that liquid mixture 130 is proximate passage 510 and signals to electric motor 518 to operate rotating ring 514 to seal passage 510 to substantially reduce intake of liquid mixture 130 into chamber 504. As such, apparatuses 500 and gas conduit 204 of gas vent system 200 provide gaseous substances 128 with an escape path that bypasses pump 132 (shown in FIG. 1) and removes substantially all of gaseous substances 128 from within horizontal portion 108 of wellbore 104 prior to gases 128 reaching pump 132 such that only liquid mixture 130 encounters pump 132. Accordingly, gas vent system 200 substantially eliminates the formation of slugs, described above, and reduces gas intake of pump 132. More specifically, gas vent system 200 substantially reduces the buildup of pressure within horizontal portion 108 of wellbore 104 such that a pressure at first point P1 is substantially similar to a pressure at second point P2 and to a pressure at third point P3. As a result, each production zone 126 along horizontal portion 108 has a substantially similar production rate rather than production zones 126 proximate heel 112 and point P3 having significantly higher production rates than production zones 126 proximate toe 114 and point P1.

Figure 6:
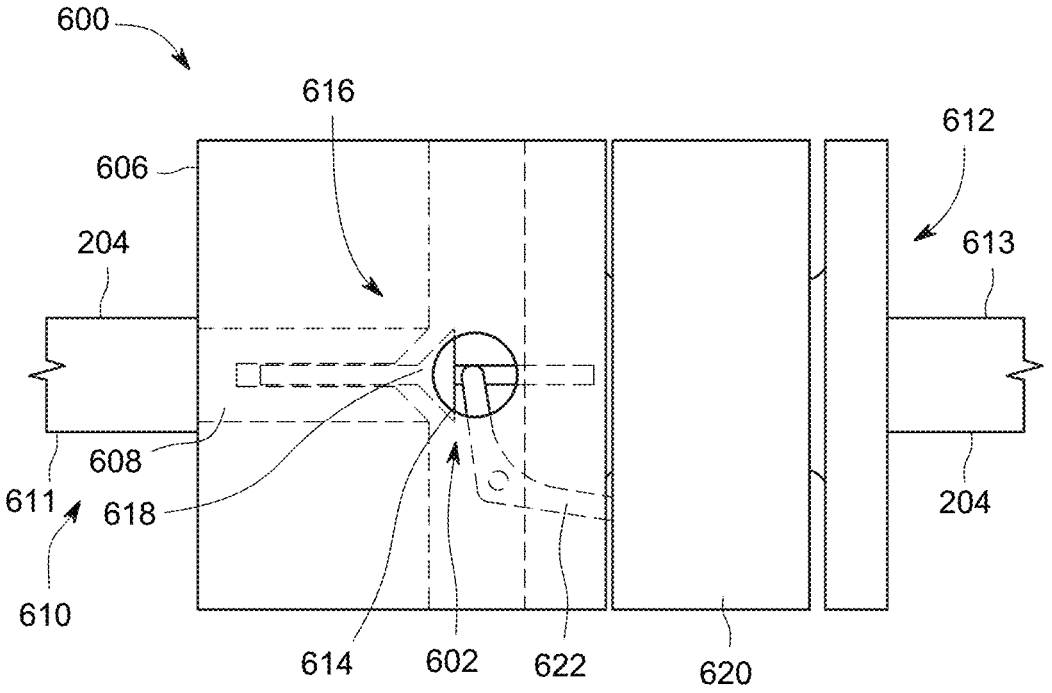
FIG. 6 is a side view of another alternative gas intake apparatus, in a first position, that may be used with the gas vent system shown in FIG. 1.
Figure 7:
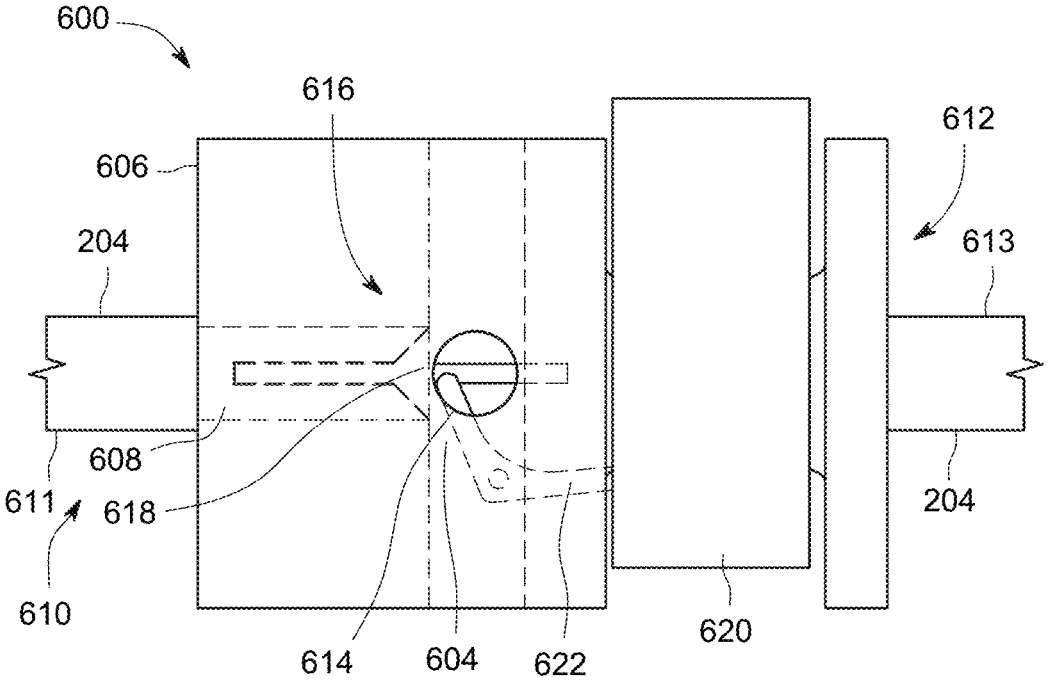
FIG. 7 is a side view of the gas intake apparatus shown in FIG. 6 in a second position.

FIG. 6 is a side view of another alternative gas intake apparatus 600, in a first position 602 that may be used with gas vent system 200 (shown in FIG. 1). FIG. 7 is a side view of gas intake apparatus 600 in a second position 604. Referring to FIGS. 6 and 7, each gas intake apparatus 600 of the at least one apparatus 202 includes a housing 606 that defines an interior chamber 608. Housing 606 includes a first end 610 coupled to a downstream portion 611 of gas conduit 204 and a second end 612 coupled to an upstream portion 613 of gas conduit 204. Housing 606 also includes at least one gas intake passage 614 that is in flow communication with chamber 608. Gas intake apparatus 600 also includes a gas intake mechanism 616 coupled to housing 606 at gas intake passage 614 such that gas intake mechanism 616 is configured to facilitate a flow of gaseous substances 128 (shown in FIG. 1) therethrough and to restrict a flow of mixture of liquids and solids 130 (shown in FIG. 1) therethrough.

In this embodiment, gas intake mechanism 616 is an actuation assembly that includes a sealing device 618, a sensor 620, and an actuator 622. Sensor 620 is positioned proximate gas intake passage 614 and is configured to determine the physical state of fluid proximate gas intake passage 614. More specifically, sensor 620 is configured to determine whether the fluid proximate gas intake passage 614 includes gaseous substances 128 or liquid mixture 130. In the exemplary embodiment, sensor 620 is a buoyancy device, such as, but not limited to, a float, that transmits a mechanical signal to actuator 622. Alternatively, sensor 620 is any other type of sensor that facilitates determining the physical state of a fluid proximate intake passage 614. Buoyancy device 620 is formed from a material that has a density less than a density of liquid mixture 130 such that when apparatus 600 is at least partially submerged in liquid mixture 130, buoyancy device 620 floats with respect to the remainder of apparatus 600, as shown in FIG. 7, to seal gas intake passage 614 from substances 128 and 130. Accordingly, buoyancy device 620 is configured to be moveable between first position 602 (only shown in FIG. 6) when only gaseous substances 128 are proximate buoyancy device 620 and second position 604 (only shown in FIG. 7), when liquid mixture 130 is proximate buoyancy device 620. When buoyancy device 620 is in first position 602, gas intake passage 614 facilitates channeling gaseous substances 128 therethrough, and when buoyancy device 620 is in second position 604, both gaseous substances 128 and liquid mixture 130 are restricted from flowing through gas intake passage 614.

Actuator 622 selectively controls sealing device 618 based on the physical state of the fluid proximate intake passage 614 as determined by buoyancy device 620. In the exemplary embodiment of apparatus 600, actuator 622 is a mechanical lever positioned within chamber 608 of housing 606, and coupled to buoyancy device 620, that selectively controls sealing device 618 based on the mechanical signal received from buoyancy device 620. Alternatively, actuator 622 is any type of actuator positioned at any location on apparatus 600 that is configured to receive a signal from buoyancy device 620 and selectively control sealing device 618 based on the signal. Lever 622 is coupled to buoyancy device 620 such that lever 622 is movable between first position 602 and second position 604 based on the position of buoyancy device 620. Accordingly, when lever 622 and buoyancy device 620 are in first position 602, lever 622 actuates sealing device 618 to first position 602 to facilitate channeling gaseous substances 128 through gas intake passage 614. However, when lever 622 and buoyancy device 620 are in second position 604, lever 622 actuates sealing device 618 to second position 604 such that sealing device 618 restricts both gaseous substances 128 and liquid mixture 130 from flowing through at least one of gas intake passage 614 and chamber 608.

In operation, apparatuses 600 are distributed along gas conduit 204 within horizontal portion 108 of wellbore 106 (both shown in FIG. 1). When gas intake apparatus 600 is surrounded by only gaseous substances 128, gas intake mechanism 616 facilitates entry of gaseous substances 128 through gas intake passage 614 and into chamber 608. More specifically, a sensor, such as buoyancy device 620, determines that only gases 128 are proximate passage 614 and signals to an actuator, such as lever 622, to operate a sealing device, such as sealing device 618, to open passage 614 to intake gases 128 into chamber 608. In embodiments where apparatus 400 is not the most upstream apparatus, gases 128 within chamber 608 mix with gases 128 that have previously entered gas vent system 200 through an upstream apparatus 600. Gases 128 are then channeled via gas conduit 204 through the remaining apparatuses 600 until gaseous substances 128 are channeled to reservoir 206 (shown in FIG. 1).

In contrast, when gas intake apparatus 600 is at least partially submerged in liquid mixture 130, gas intake mechanism 616 obstructs ingress of liquid mixture 130 into chamber 608 through gas intake passage 614. More specifically, buoyancy device 620 determines that liquid mixture 130 is proximate passage 614 and signals to lever 622 to operate sealing device 618 to seal passage 614 to substantially reduce intake of liquid mixture 130 into chamber 608. As such, apparatuses 600 and gas conduit 204 of gas vent system 200 provide gaseous substances 128 with an escape path that bypasses pump 132 (shown in FIG. 1) and removes substantially all of gaseous substances 128 from within horizontal portion 108 of wellbore 104 prior to gases 128 reaching pump 132 such that only liquid mixture 130 encounters pump 132. Accordingly, gas vent system 200 (shown in FIG. 1) substantially eliminates the formation of slugs, described above, and reduces gas intake of pump 132. More specifically, gas vent system 200 substantially reduces the buildup of pressure within horizontal portion 108 of wellbore 104 such that a pressure at first point P1 is substantially similar to a pressure at second point P2 and to a pressure at third point P3. As a result, each production zone 126 along horizontal portion 108 has a substantially uniform production rate with respect to wellbore pressure rather than production zones 126 proximate heel 112 and point P3 having significantly higher production rates than production zones 126 proximate toe 114 and point P1.

The above described horizontal well systems facilitate efficient methods of well operation. Specifically, in contrast to many known well completion and production systems, the horizontal well systems as described herein substantially remove gaseous substances from a wellbore that substantially reduces the formation of gas slugs in the wellbore. More specifically, the horizontal well system described herein includes a gas vent system that includes at least one gas intake apparatus positioned in a horizontal portion of a wellbore and distributed along a common gas conduit. Each of the gas intake apparatuses include a gas intake mechanism that facilitates a flow of gaseous substances therethrough when the apparatus is surrounded by gas and that restricts a flow of a mixture of solids and liquids therethrough when the apparatus is at least partially submerged in the mixture. In one embodiment, the apparatus includes a gas-permeable membrane that filters gaseous substances from liquids and solids. In another embodiment, each apparatus includes an actuator assembly that includes a sensor, an actuator, and a sealing device. In such embodiments, the sensor determines whether the apparatus is surrounded by gas or by liquids. Once a determination is made, the sensor signals to the actuator to control the sealing device accordingly such that the sealing device is either open to allow gas into the apparatus or closed to significantly gas and liquids from entering the apparatus.

As such, the gas vent system described herein provides gaseous substances with an escape path that bypasses the pump and removes substantially all of the gaseous substances from within the horizontal portion of the wellbore prior to the gases reaching the pump such that only the liquid mixture encounters the pump. Alternatively, the gas vent systems described herein are used in horizontal wells that seek to recover only gaseous substances, and, therefore, do not include a pump. Accordingly, the gas vent systems described herein substantially eliminate both the buildup of pressure upstream from the pump and the formation of slugs, as described above. More specifically, the gas vent systems described herein substantially reduce the buildup of pressure within the wellbore such that the horizontal portion of the wellbore achieves a nearly constant minimum pressure along its length that maximizes the production rate and the total hydrocarbon recovery of the horizontal well.

An exemplary technical effect of the methods, systems, and apparatus described herein includes at least one of: (a) maximizing the production rate of a well by achieving a constant minimum pressure along a horizontal length of the wellbore; and (b) reducing the operational costs of the well by protecting the pump from inhaling gas slugs that may cause a reduction in the expected operational lifetime of the pump;

Exemplary embodiments of methods, systems, and apparatus for removing gas slugs from a horizontal wellbore are not limited to the specific embodiments described herein, but rather, components of systems and steps of the methods may be utilized independently and separately from other components and steps described herein. For example, the methods may also be used in combination with other wells, and are not limited to practice with only the horizontal well systems and methods as described herein. Rather, the exemplary embodiment can be implemented and utilized in connection with many other applications, equipment, and systems that may benefit from creating independent gas and liquid flow paths.

Although specific features of various embodiments of the disclosure may be shown in some drawings and not in others, this is for convenience only. In accordance with the principles of the disclosure, any feature of a drawing may be referenced and claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gas intake apparatus for use in a wellbore, the wellbore configured to channel a mixture of fluids and solids, said gas intake apparatus comprising:

a housing defining an interior chamber, said housing comprising a first end coupled to a downstream portion of a gas conduit and a second end coupled to an upstream portion of the gas conduit, said housing further defining at least one gas intake passage in flow communication with said chamber; and a gas intake mechanism coupled to said housing at said at least one gas intake passage, said gas intake mechanism configured to facilitate a flow of gaseous substances therethrough and to restrict a flow of solids and liquids therethrough, wherein the gas intake apparatus and the gas conduit provide the gaseous substances with an escape path from within a horizontal portion of the wellbore.

2. The gas intake apparatus in accordance with claim 1, wherein said gas intake mechanism comprises at least one membrane layer.

3. The gas intake apparatus in accordance with claim 2, wherein said at least one membrane layer comprises a plurality of micro-pores that facilitate the flow of gaseous substances therethrough and restrict the flow of solids and liquids therethrough.

4. The gas intake apparatus in accordance with claim 2, wherein said at least one membrane layer is comprised from a material comprising at least one of polytetrafluoroethylene, polyetheretherkeytone, and polyetherkeytone.

5. The gas intake apparatus in accordance with claim 1, wherein said gas intake mechanism comprises an actuation assembly comprising:

a sealing device configured to selectively seal said gas intake passage;

a sensor positioned proximate said gas intake passage, said sensor configured to determine a physical state of a fluid proximate said gas intake passage; and an actuator configured to selectively control said sealing device based on the determined physical state of the fluid.

6. The gas intake apparatus in accordance with claim 5, wherein said sensor comprises a buoyancy device configured to be moveable between a first position and a second position, wherein when said buoyancy device is in the first position said at least one gas intake passage facilitates channeling the flow of gaseous substances therethrough, and wherein when said buoyancy device is in the second position said at least one gas intake passage restricts the flow of solids and liquids therethrough.

7. The gas intake apparatus in accordance with claim 5, wherein said actuator comprises a lever configured to be moveable between a first lever position and a second lever position based on the determined state of the flow of fluid, wherein when said lever is in the first lever position said sealing device facilitates channeling the flow of gaseous substances therethrough, and wherein when said lever is in the second lever position said a sealing device restricts the flow of solids and liquids therethrough.

8. The gas intake apparatus in accordance with claim 5, wherein said sensor is configured to determine whether the fluid proximate said gas intake passage comprises the flow of gaseous substances or the flow of solids and liquids.

9. A gas vent system for use in a wellbore, the wellbore configured to channel a mixture of fluids and solids, said gas vent system comprising:

a gas vent conduit positioned within the wellbore; and a plurality of gas intake apparatuses coupled to said gas vent conduit, each of said gas intake apparatuses comprising: a corresponding housing defining an interior chamber, said housing comprising a first end coupled to a downstream portion of the gas vent conduit and a second end coupled to an upstream portion of the gas vent conduit, and a gas intake mechanism configured to facilitate a flow of gaseous substances therethrough and to restrict a flow of solids and liquids therethrough, wherein the plurality of gas intake apparatuses and the gas vent conduit provide the gaseous substances with an escape path from within a horizontal portion of the wellbore.

10. The gas vent system in accordance with claim 9, wherein said gas intake mechanism comprises at least one membrane layer.

11. The gas vent system in accordance with claim 10, wherein said at least one membrane layer comprises a plurality of micro-pores that facilitate the flow of gaseous substances therethrough and restrict the flow of solids and liquids therethrough.

12. The gas vent system in accordance with claim 9, wherein said gas intake mechanism comprises an actuation assembly comprising:

a sealing device configured to selectively seal said gas intake passage;

a sensor positioned proximate said gas intake passage, said sensor configured to determine a physical state of a fluid proximate said gas intake passage; and an actuator configured to selectively control said sealing device based on the determined physical state of the fluid.

13. The gas vent system in accordance with claim 12, wherein said sensor is configured to determine whether the fluid proximate said gas intake passage comprises the flow of gaseous substances or the flow of solids and liquids.

14. The gas vent system in accordance with claim 12, wherein said sensor comprises an electronic sensor configured to transmit a signal to said actuator.

15. The gas vent system in accordance with claim 14, wherein said actuator comprises an electric motor configured to control said sealing device based on said signal.

16. A method of operating a well using a gas vent system, said method comprising:

positioning a gas vent conduit within a wellbore of the well, the gas vent conduit including a plurality of gas intake apparatuses coupled thereto, each gas intake apparatus including a corresponding housing defining an interior chamber, said housing comprising a first end coupled to a downstream portion of the gas vent conduit and a second end coupled to an upstream portion of the gas vent conduit, and a gas intake mechanism;

channeling substances about the plurality of gas intake apparatuses, the substances including one or more of at least one gaseous substance, at least one solid substance, and at least one liquid substance;

channeling at least a portion of the at least one gaseous substance through the gas intake mechanism;

restricting a flow of the at least one solid substance and the at least one liquid substance from flowing through the gas intake mechanism; and providing the at least a portion of the at least one gaseous substance with an escape path from within a horizontal portion of the wellbore and through the plurality of gas intake apparatuses and the gas vent conduit.

17. The method in accordance with claim 16, wherein channeling at least a portion of the at least one gaseous substance through the gas intake mechanism comprises channeling at least a portion of the at least one gaseous substance through at least one membrane layer.

18. The method in accordance with claim 17, wherein channeling at least a portion of the at least one gaseous substance through at least one membrane layer comprises channeling at least a portion of the at least one gaseous substance through at least one membrane layer defining a plurality of micro-pores therein.

19. The method in accordance with claim 16, wherein channeling at least a portion of the at least one gaseous substance through the gas intake mechanism comprises channeling at least a portion of the at least one gaseous substance through an actuation assembly.

20. The method in accordance with claim 19, wherein channeling at least a portion of the at least one gaseous substance through the actuation assembly comprises:

determining, using a sensor, a state of a flow of fluid about the gas intake valve; and operating an actuator to selectively seal a gas intake passage defined by the gas intake valve based on the determined state of the flow of fluid.

* * * * *